US006024917A

United States Patent [19]

Kamstra

[11] Patent Number: 6,024,917

[45] Date of Patent: Feb. 15, 2000

[54] STERILIZATION DEVICE AND METHOD FOR STERILIZING OBJECTS

[75] Inventor: Paulus Rein Kamstra, Zegveld, Netherlands

[73] Assignee: Stork Amsterdam B.V., Amsterdam, Netherlands

[21] Appl. No.: 09/224,922

[22] Filed: Jan. 4, 1999

Related U.S. Application Data

[63] Continuation of application No. PCT/NL97/00383, Jul. 4, 1997.

[30] Foreign Application Priority Data

Jul. 5, 1996 [NL] Netherlands ..... 1003520

[51] Int. Cl.[7] ..... A61L 2/16

[52] U.S. Cl. ..... 422/33; 422/302; 422/303; 422/304

[58] Field of Search ..... 422/28, 33, 302, 422/303, 304

[56] References Cited

U.S. PATENT DOCUMENTS 3,376,689 4/1968 Simpson et al. .

FOREIGN PATENT DOCUMENTS 32 20 451 A1 12/1983 Germany .
37 01 079 A1 7/1988 Germany .
2 084 550 4/1982 United Kingdom .

*Primary Examiner*—E. Leigh McKane
*Attorney, Agent, or Firm*—Mark S. Leonardo, Esq.; Brown, Rudnick, Freed & Gesmer, P.C.

[57] ABSTRACT

Sterilization device intended to sterilize objects, such as bottles, comprising feed and discharge means for objects, a rotatable treatment unit, which in the region of its circumference comprises treatment cavities, each treatment cavity comprising an opening for feeding and discharging the objects, which opening can be closed and opened with the aid of closure means in the form of an endless belt which bears against the treatment unit over at least a part of its circumference, and it being possible to connect the treatment cavities to a feed for process media. A description is also given of a method for sterilizing objects using the device.

8 Claims, 3 Drawing Sheets

STERILIZATION DEVICE AND METHOD FOR STERILIZING OBJECTS

This is a continuation of PCT/NL97/00383 filed Jul. 4, 1997.

BACKGROUND OF THE INVENTION

The present invention relates to a sterilization device intended to sterilize objects, comprising feed and discharge means for objects, a rotatable treatment unit, which in the region of its circumference comprises treatment cavities, each treatment cavity comprising an opening for feeding and discharging the objects, which opening can be closed and opened with the aid of closure means, and it being possible to connect the treatment cavities to a feed for process media.

A sterilization device of this kind is known from U.S. Pat. No. 4,981,649. This American patent discloses a device for filling and sealing containers under sterile conditions. In particular, a description is given of a treatment unit which is used for sterilizing and feeding covers to the filled sterile containers. The treatment cavities in this treatment unit are sealed by a fixed drum-like external enclosure which bears in a sliding manner against the treatment unit. This external enclosure has openings which serve for the feed and discharge of covers and for feeding sterilization medium, warm dry air, etc. to the treatment cavities.

Owing to the sliding contact of the closure means of this treatment unit, it has been found in practice that the sealing of the treatment cavities is insufficient. Sterilization medium could thus escape, media could be exchanged between treatment cavities, etc., which is of course undesirable.

To date, there is still no satisfactory solution available for sealing treatment cavities in a rotatable treatment unit in a simple yet certain manner.

SUMMARY OF THE INVENTION

The object of the present invention is to solve the above problems, and to this end is characterized in that the closure means of the treatment unit comprise at least one endless belt which bears against the treatment unit over a part of the circumference thereof.

This provides a simple and certain sealing of the treatment cavities. The optionally driven endless belt which is in contact with the treatment unit is entrained together with the treatment unit during rotation thereof.

In the present description, sterilization is intended to mean both internal and external sterilization.

In this case, it is possible to use one endless belt, although depending on the specific application it is also possible to use a plurality of separate endless belts. Thus, for example, the treatment unit can be fed with objects to be treated from two opposite sides, the objects also being removed again at the opposite sides. In this case, therefore, sterilization takes place during half a revolution of the treatment unit. If both halves are to be used for sterilisation purposes, at least two endless closure belts will be necessary. Such an endless belt is advantageously a guided moving belt.

During the rotation of the treatment unit, the objects are subjected to the various sterilization steps. These may comprise, for example, one or more steps of applying a vacuum, treatment with sterilization medium, feeding sterile air, heating, etc.

The objects to be sterilized with the aid of the device according to the invention are not particularly limited, but the device is particularly suitable for sterilizing containers, such as bottles, jars and the like. However, for the sake of clarity, the treatment of bottles will primarily be discussed in the following text.

Although the treatment unit may have various forms and may comprise, for example, various segments which are coupled movably to one another, are guided, for example, by guide shafts and may have any desired form, it is preferred for the treatment unit to be of substantially circular design.

In order to be able to protect the sterilized objects from external influences such as contamination and the like, it is preferred for the entire treatment unit to be accommodated in an enclosure in which a slight excess pressure can be applied.

In particular, the treatment unit comprises a separate feed and discharge for the objects to be sterilized. This prevents recontamination of the sterilized objects by as yet unsterilized objects or non-sterile gas (air) entrained thereby.

In a preferred embodiment of the sterilization device according to the invention, the feed and discharge for the objects to be sterilized are situated at least one treatment cavity apart and are separated by partition means which provide a seal with respect to the treatment unit over the distance of at least one treatment cavity. If the feed and discharge openings are more than one treatment cavity apart from each other, the partition means can provide such a seal over the corresponding distance. An endless belt is present, which bears against the treatment unit over substantially the remaining part of the circumference of the treatment unit.

"One treatment cavity apart" is intended to mean the distance between the centre of a treatment cavity and the centre of an adjacent treatment cavity.

The partition means may be designed in the form of a partition element which bears against the treatment unit in a sliding manner, but preference is given to an additional endless belt which bears against the treatment unit.

The invention furthermore relates to a method for sterilizing objects using the device according to the invention, at least comprising the steps of:

rotatably driving the treatment unit;

feeding the objects to be sterilized to the treatment cavities;

closing the treatment cavities;

subjecting the objects to a treatment using a sterilization medium in the closed treatment cavities;

opening the treatment cavity;

discharging the sterilized objects from the treatment cavities.

The method according to the invention makes it possible to sterilize objects in a large number of ways, using all kinds of sterilization media, such as gases, vapours, liquids and the like. The objects are advantageously placed in separate treatment cavities, which are preferably adapted to the dimensions of the objects to be treated.

In particular, the treatment unit is driven in rotation at a substantially constant speed. This provides the possibility of incorporating the treatment unit in line in a filling line without disrupting the speed of the line. Furthermore, a substantially constant rotational speed of the treatment unit results in less wear to components and is less susceptible to faults. The treatment unit can also be driven with sinusoidally varying speed; the objects to be sterilzed can then advantageously be fed and discharged at minimal speed of the treatment unit. This minimal speed can optionally be zero.

Particularly advantageously, heating means are present for controlling the temperature of the treatment unit. This makes it possible to assist the sterilization of the objects. The treatment unit will often be kept at a temperature such that condensation is prevented from forming, in the event that a sterilization gas is used. If $H_2O_2$ is used, this temperature will be about 70–80° C.

In order to improve the sterilization action of the sterilization medium still further, it is preferred to place the treatment cavities under a vacuum before feeding the said sterilization medium.

BRIEF DESCRIPTION OF THE DRAWINGS

The invention will be explained and exemplified in more detail below with reference to the appended drawing, in which:

In FIG. 1, 1 denotes a treatment unit which, in the region of its circumference, comprises treatment cavities 2 and can be driven in rotation in the direction of the arrow, by means of a drive (not shown in more detail) at e.g. a constant speed or with sinusoidally varying speed. 3 denotes an endless belt which is guided over rollers 4 and bears against the treatment unit 2 over a considerable part of the outer circumference of the treatment unit 1. An enclosure 5 encloses the treatment unit 1 and the endless belt 3 and comprises a feed opening 6 and a discharge opening 7, the feed and discharge of the bottles 8 being shown schematically. Preferably, the feed opening 6 and the discharge opening 7 are designed to be as small as possible, in order to avoid contact with the environment.

Figure 1:
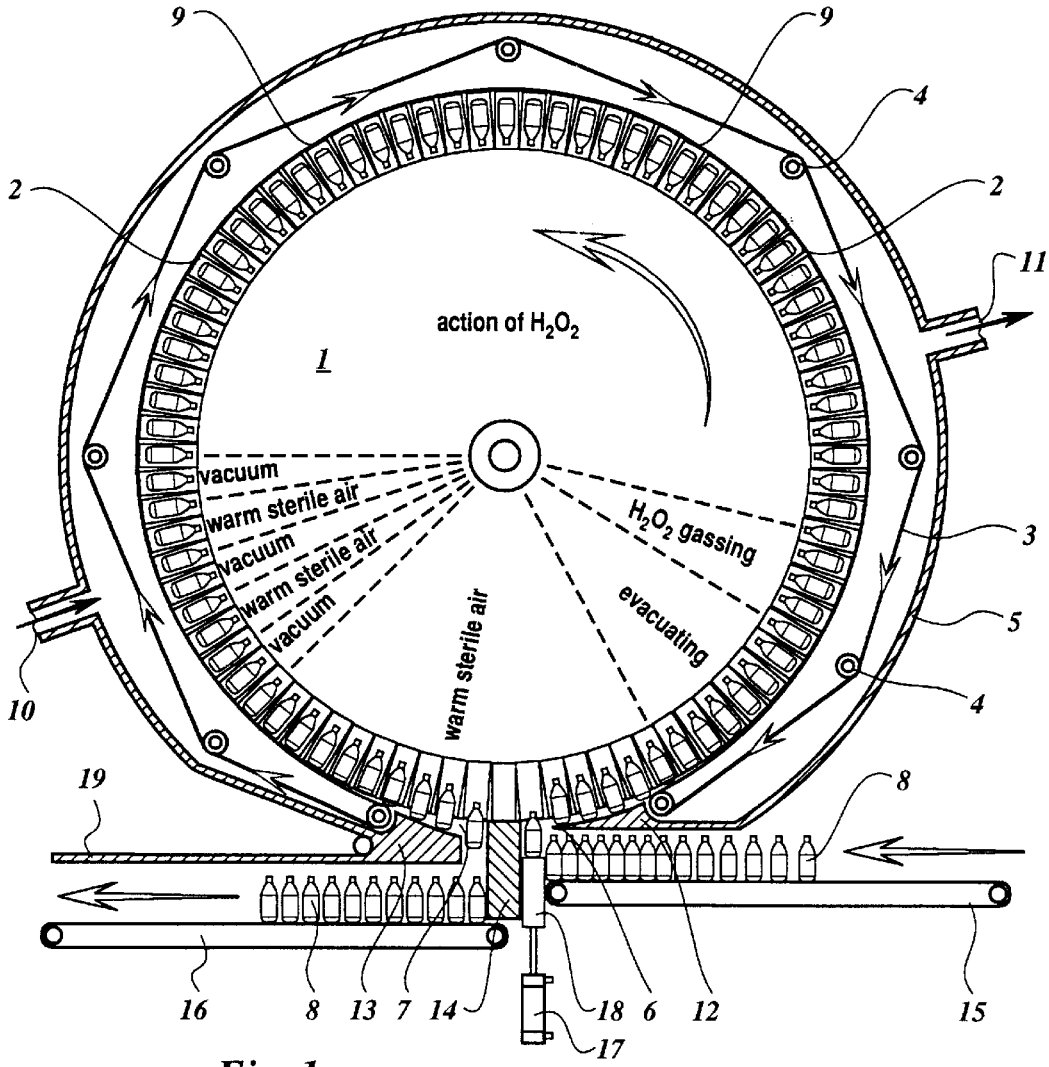
FIG. 1 shows a diagrammatic cross-section of an embodiment of the sterilization device according to the invention.

The endless belt 3 bears against the treatment unit over a considerable part of its circumference and thus seals the feed entrance 9 of a number of treatment cavities 2. Via the feed entrance 9, an object to be sterilized can be introduced into the corresponding treatment cavity 2 and removed therefrom.

The enclosure 5 furthermore comprises a feed and discharge duct (10 and 11, respectively) for allowing a sterile gas, such as sterile air, which is preferably under a slight excess pressure, to flow through its interior.

Preferably, an additional recess for a closure, such as a cap or the like, in the case of bottles, is present in the treatment cavities 2 or close to the treatment cavity in the treatment unit.

12 and 13 denote guide components which serve to guide the bottles 8 into and out of the device.

A partition element 14, which prevents the possibility of recontamination of sterilized bottles 8, is present between the feed opening 6 and the discharge opening 7. Advantageously, however, this partition is designed in the form of an additional endless belt which bears against the treatment unit. The partition element 14 may be integral with the enclosure 5.

As indicated schematically, the bottles 8 are supplied with the aid of a moving belt 15 and discharged with the aid of a moving belt 16. 17 indicates a piston which serves to displace a piston rod 18, by means of which the bottles 8 are placed in the treatment cavities. This introduction action can be carried out while the treatment unit 1 is rotating, or, if the unit is driven with sinusoidally varying speed, while the rotational speed of the treatment unit 1 is at its minimum.

As indicated in FIG. 1 in the treatment unit 1, an introduced bottle 8 in a treatment cavity is first brought to the correct temperature using warm sterile air. The feed entrance 9 is then closed by means of the endless belt 3 and the treatment cavity 2 is placed under a vacuum. A sterilization medium, in this case $H_2O_2$, is then fed in, which medium can act for a period of time. Finally, a number of times, a vacuum is applied and the cavity is flushed with warm sterile air.

The various operations are, roughly distributed over time, all shown in the figure. Other time distributions are, however possible. The bottle ultimately leaves the device via the opening 7 and the moving belt 16, the latter preferably likewise being present in an enclosure 19, in order to ensure sterility of discharged bottles 8.

During the successive steps of the treatment, the treatment unit 1 is kept at a temperature, in case of $H_2O_2$ as sterilizing medium, of 75° C. by means of a heating element, which is not shown in more detail and is accommodated in the treatment unit. It will be clear that numerous other forms of heating are likewise suitable.

During the sterilizing operation, a bottle 8 in a treatment cavity moves from a substantially vertical orientation, via a horizontal orientation, into an opposite vertical orientation. The bottle 8 can thus move in the treatment cavity 2 with respect to the walls such that all sides of the said bottle can come into contact with the sterilization gas.

Figure 2:
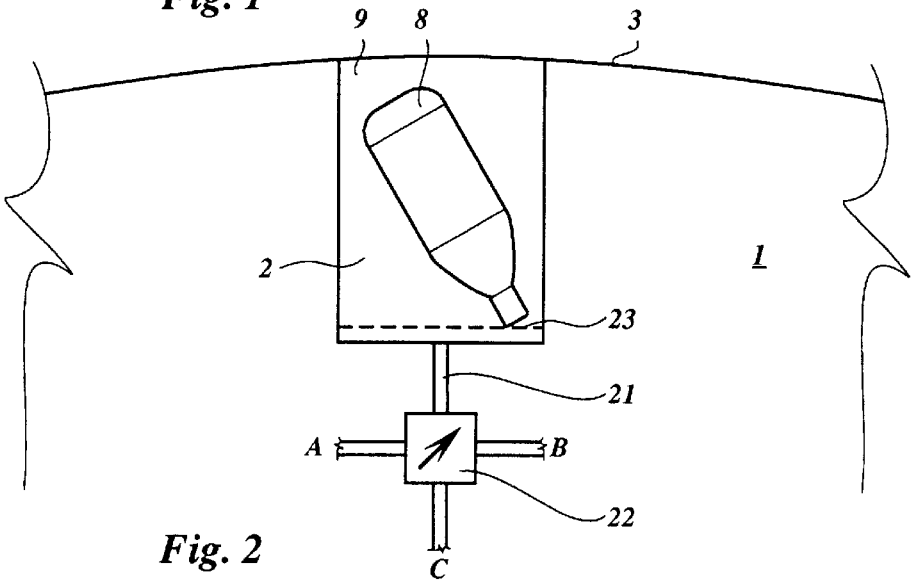
FIG. 2 shows a diagrammatic cross-section of a treatment cavity in a treatment unit according to the invention.

FIG. 2 shows more clearly a treatment cavity 2 in the treatment unit 1, in which cavity a bottle 8 is present. The bottle 8 lies freely in the treatment cavity 2. The treatment cavity 2 is connected to a line 21, which can be connected to various media sources A, B, C via a four-way valve 22. In the first instance, consideration may be given for these media to vacuum, sterilization medium and sterile air. Naturally, the number of connections is not limited. The various media could also be fed in in the manner as disclosed in U.S. Pat. No. 4,981,649 or EP-A-0,632,965.

23 denotes a grid which serves to keep the bottle 8 at a distance from the opening of the line 21, in order to prevent the bottle from being sucked onto the said opening during the application of the vacuum.

Figure 3:
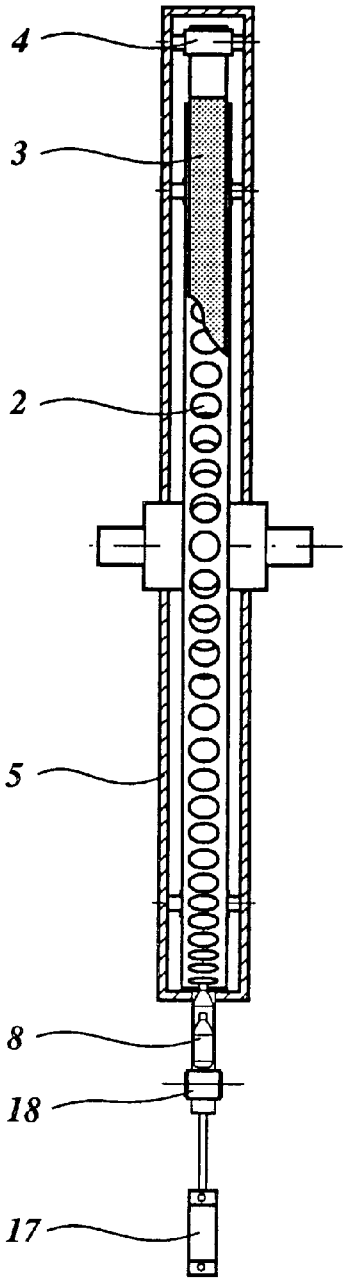
FIG. 3 shows a side view of the device in accordance with FIG. 1, which is partially cut away.
Figure 4:
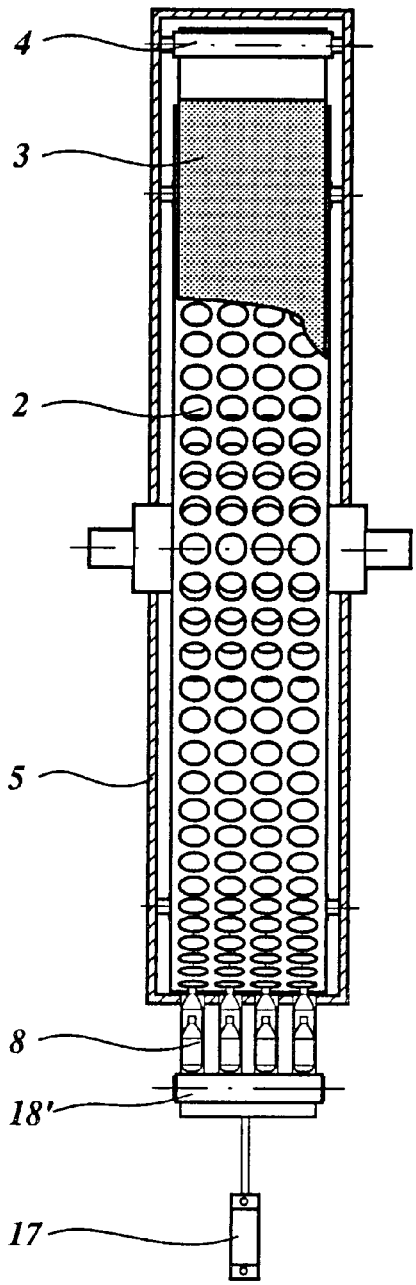
FIG. 4 shows a side view of another embodiment of the device according to the invention, which is partially cut away.

FIG. 3 shows a side view of the device from FIG. 1, partially cut away; as can be seen, the treatment unit 1 comprises a single series of treatment cavities 2 close to its circumference. However, the invention is not limited to this embodiment, and the treatment unit 1 may possess a plurality of series of treatment cavities 2 close to its circumference, as shown in FIG. 4, in which four series are present. In this case, the piston rod is adapted accordingly, as indicated at 18'.

Figure 5:
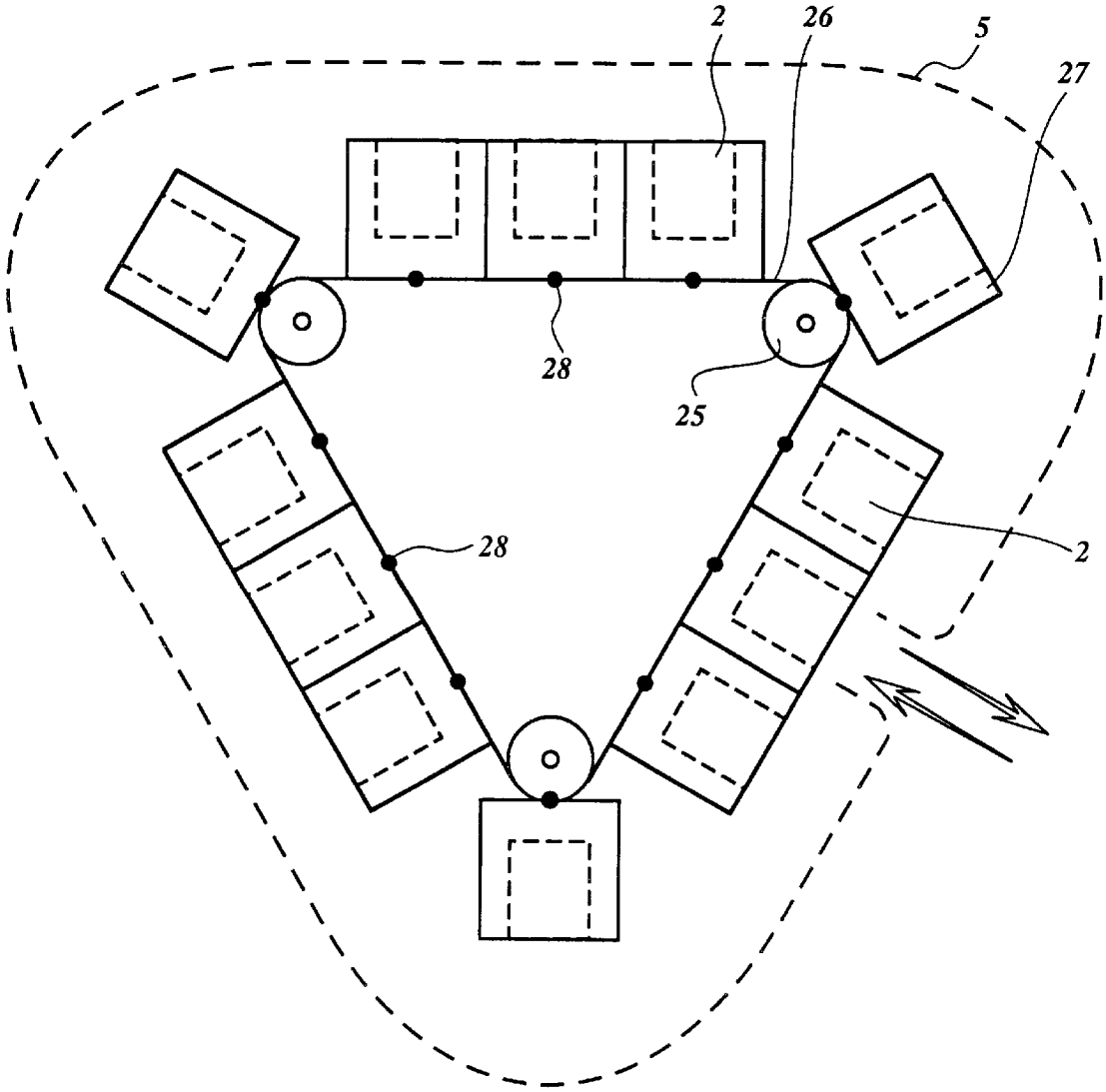
FIG. 5 shows a diagrammatic cross-section of an embodiment of the device according to the invention having a treatment unit comprising coupled segments.

Finally, FIG. 5 shows a variant of the sterilization device in accordance with FIG. 1, with an enclosure 5 and a treatment unit 1 therein, which unit comprises an endless belt 26 guided by means of guide rollers 25, to which belt segments 27 are coupled at 28. It will be clear that the design comprising segments 27 offers the possibility of designing the treatment unit 1 in a wide variety of manners. For the sake of simplicity, the endless belt for sealing the treatment cavities 2 is not shown.

As in the device according to the present invention, the successive operations of applying a vacuum, sterilizing and the like take place during rotation of the treatment unit 1, the sterilizing can be carried out rapidly and continuously in line in view of the process of manufacturing, sterilizing and filling bottles. The dimensions of the treatment unit 1, the number of treatment cavities 2 and the number of series can be fixed as a function of the feed rate of the bottles.

Although the treatment unit is disposed vertically in the figures, and this configuration is preferred, another orientation of the treatment unit could likewise be used. However, it needs to be ensured that an object to be sterilized is completely sterilized during the sterilization and therefore that it is not continuously supported at one location. A number of solutions are possible to ensure this. If the treatment unit were to be disposed horizontally, the treatment cavities may, for example, be designed such that they can be rotated around an axis which runs radially with respect to the treatment unit. As a result, the objects can roll through the chambers and be sterilized on all sides.

Further it is to be noted that the location of the feed opening 6 for the objects 8 to be sterilized is not limited. With a vertical arrangement of the device, the feed opening 6 can be situated at the left or righthand side of the treatment unit 1, so that the object 8 can be introduced into the treatment cavities 2 in a horizontal position. Said feed opening 6 can also be situated between one of the said sides and the top of the treatment unit 1. With the feed opening 6 at such a position, the objects 8 can be introduced into the treatment cavities 2 without the aid of a piston-driven upward movement, but with the aid of gravity.

With the feed opening 6 situated at or above the side of the treatment unit, the position of the discharge opening 7 for the objects 8 can then be just below said side, or the opposite side, the objects being rotated for sterilization almost a complete or half a revolution of the treatment unit, respectively, and being discharged with the aid of gravity.

Abovementioned horizontal feed of objects, e.g. bottles, has the advantage, that before the said feed, the bottoms of the bottles are also exposed and freely accessible for e.g. an additional heat pre-treatment. Such a treatment can namely be of importance to avoid condensation of the sterilizing medium on relatively cold surfaces of the bottles within the treatment unit 1.

As is outlined above, the sterilization treatment can also be completed within half or three quarter of of revolution of the treatment unit 1. The remaining part of the treaetment unit can be sealed by partition means (see above), or can be used to gain acces to the treatment cavities, e.g. to remove objects, that became locked in said cavities during the strilization treatment, or for maintenance purposes.

What is claimed is:

1. A sterilization device intended to sterilize objects, comprising:

a means for feeding and discharging objects;

a rotatable treatment unit, which in the region of its circumference comprises individual treatment cavities for each object to be sterilized, each of the treatment cavities having an entrance for feeding and discharging the objects;

at least one of the treatment cavities being in communication with a means for the administration of process media; and a closure means for sealing the treatment cavities in the rotatable treatment unit including at least one endless belt which bears against the treatment unit over a part of the circumference thereof.

2. Sterilization device according to claim 1, wherein the entire treatment unit is accommodated in an enclosure in which a slight excess pressure can be applied.

3. Sterilization device according to claim 1 wherein the treatment unit comprises a separate feed and discharge for the objects to be sterilized.

4. Sterilization device according to claim 3, wherein the feed and discharge for the objects to be sterilized are situated at least one treatment cavity apart and are separated by partition means which provide a seal with respect to the treatment unit over the distance of at least one treatment cavity, and in that an endless belt is present, which bears against the treatment unit over substantially the remaining part of the circumference of the treatment unit.

5. A method for sterilizing objects using a sterilization device comprising the steps of:

providing a sterilization device including a rotatable treatment unit having individual treatment cavities for each object to be sterilized and a closure means for sealing the individual treatment cavities;

rotatably driving the treatment unit;

feeding each of the objects to be sterilized into the individual treatment cavities;

sealing the individual treatment cavities by bearing at least one endless belt against the treatment unit;

exposing the objects in the sealed treatment cavities to a sterilization medium for a period of time;

unsealing the treatment cavities; and discharging the sterilized objects from the treatment cavities.

6. Method according to claim 5, wherein the treatment unit is driven in rotation at a substantially constant speed.

7. Method according to claim 5, wherein heating means are present for controlling the temperature of the treatment unit.

8. Method according to claim 5, wherein the treatment cavities are placed under a vacuum before feeding the sterilization agent.

* * * * *